US010302004B2

(12) United States Patent
Sugiura et al.

(10) Patent No.: US 10,302,004 B2
(45) Date of Patent: May 28, 2019

(54) WATER PUMP UNIT

(71) Applicant: HONDA MOTOR CO., LTD., Minato-ku, Tokyo (JP)

(72) Inventors: Hiroyuki Sugiura, Wako (JP); Hiroshi Yokota, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 172 days.

(21) Appl. No.: 15/514,867

(22) PCT Filed: Sep. 29, 2014

(86) PCT No.: PCT/JP2014/075838
§ 371 (c)(1),
(2) Date: Mar. 28, 2017

(87) PCT Pub. No.: WO2016/051455
PCT Pub. Date: Apr. 7, 2016

(65) Prior Publication Data
US 2017/0234205 A1 Aug. 17, 2017

(51) Int. Cl.
*F01P 5/12* (2006.01)
*F04D 13/02* (2006.01)
*F04D 29/40* (2006.01)

(52) U.S. Cl.
CPC ..... *F01P 5/12* (2013.01); *F04D 13/02* (2013.01); *F04D 29/406* (2013.01)

(58) Field of Classification Search
CPC ..... F01P 5/12; F01P 7/14; F01P 11/0214
USPC ..... 123/41.31, 42.01
See application file for complete search history.

(56) References Cited

U.S. PATENT DOCUMENTS 1,295,234 A * 2/1919 Szekely ..... F01P 5/10 123/41.47
1,463,569 A * 7/1923 Bathrick ..... A62C 27/00 169/24
2,078,695 A * 4/1937 Svenson ..... B23B 7/02 29/42
2,223,592 A * 12/1940 Barton ..... F04D 13/14 169/24
2,568,473 A * 9/1951 Tucker ..... F02B 67/04 123/195 A
2,769,303 A * 11/1956 Lucia ..... F02B 33/00 123/561

(Continued)

FOREIGN PATENT DOCUMENTS

JP S61-1819 A 1/1986
JP 2000-161058 A 6/2000

(Continued)

*Primary Examiner* — Charles G Freay
(74) *Attorney, Agent, or Firm* — Carrier Blackman & Associates, P.C.; Joseph P. Carrier; Jeffrey T. Gedeon

(57) ABSTRACT

A water pump unit has, within a water pump case, a drive shaft for driving an impeller, and a transmission member for transmitting power of a power supply device to the drive shaft. The water pump unit is configured such that the water pump case receives therein and supports the drive shaft, the transmission member is supported by the water pump case by means of the drive shaft with a part of the transmission member protruding from within the water pump case, and an attachment surface of the water pump case, for joining the water pump case to the power supply device, is formed to extend along the transmission member.

7 Claims, 8 Drawing Sheets

(56) References Cited

U.S. PATENT DOCUMENTS

| | | | | | |
|---|---|---|---|---|---|
| 2,914,137 | A * | 11/1959 | Sykes, Jr. | F02B 75/20 | 123/192.2 |
| 3,500,961 | A * | 3/1970 | Eberhardt | F04D 1/006 | 184/31 |
| 4,198,935 | A * | 4/1980 | Seibt | F01P 5/12 | 123/195 A |
| 4,662,320 | A * | 5/1987 | Moriya | F01L 1/053 | 123/198 C |
| 5,145,014 | A * | 9/1992 | Eberhardt | A62C 5/02 | 169/13 |
| 7,892,054 | B2 | 2/2011 | Fukuoka | | |
| 8,376,719 | B2 * | 2/2013 | Grady | A62C 27/00 | 417/223 |

FOREIGN PATENT DOCUMENTS

| | | | |
|---|---|---|---|
| JP | 2000-170630 | A | 6/2000 |
| JP | 2000-257428 | A | 9/2000 |
| JP | 2003-239740 | A | 8/2003 |
| JP | 2006-283778 | A | 10/2006 |
| JP | 2009-149185 | A | 7/2009 |

* cited by examiner

WATER PUMP UNIT

TECHNICAL FIELD

The present invention relates to a water pump unit installed on a power supply device.

BACKGROUND ART

Patent Document 1 below discloses a water pump unit attached or mounted to the crankcase of an internal combustion engine at an outer surface of a vertical wall of an oil pan, wherein the water pump unit is driven by a drive shaft thereof joined coaxially to an oil pump drive shaft provided within the oil pan.

The water pump unit disclosed in Patent Document 1 has a disadvantage in that the vertical wall of the oil pan has to be formed with a large opening through which a part of the housing of the water pump unit is to be passed and an area occupied for joining associated component parts is enlarged. A further disadvantage is that a part of the drive shaft of the water pump unit is disposed within the crankcase so that assembling operation for the water pump unit is complicated.

PRIOR ART DOCUMENT

Patent Document

[Patent Document 1] JP 2000-161058 A (FIGS. 2, 11 and 12)

DISCLOSURE OF THE INVENTION

Problem to be Solved by the Invention

The present invention has been made in view of the prior art above, and the object of the invention is to provide a water pump unit in which an attachment or joining surface with which the water pump unit is attached to the power supply device is reduced in size, an opening to be formed in the power supply device is also reduced in size, and the assembling operation of the water pump unit is made easy and simple.

Means for Solving the Problem

To solve the above underlying problem, the present invention provides a water pump unit including a water pump case provided with a drive shaft for driving an impeller, and a power transmission member for transmitting power from a power supply device to the drive shaft, wherein: the water pump case supports the drive shaft therein; the power transmission member is supported by the water pump case through the drive shaft and protrudes in part from within the water pump case; and the water pump case has an attachment surface with which the water pump case is attached to the power supply device, the attachment surface being formed to extend along the power transmission member.

In a second form of the invention, the power transmission member is a driven gear driven by the power supply device.

In a third form of the invention, the driven gear is supported by the drive shaft and has a radial size greater than an axial size thereof in the direction of the drive shaft.

In a fourth form of the invention, the power supply device is a power unit including an internal combustion engine, and the water pump unit is attached to a crankcase of the power unit.

In a fifth form of the invention, the water pump unit is attached to the crankcase of the power unit by means of fixing bolts, and the fixing bolts extend in an axial direction perpendicular to the drive shaft of the water pump unit.

Effect of the Invention

According to the present invention, the attachment surface with which the water pump case is attached to the power supply device is formed to extend along the power transmission member. Therefore, the attachment surface can be made small, and an opening formed in the power supply device can hence be made small so that rigidity of the power supply device is secured.

According to the second form of the invention, the power transmission member is a driven gear in the form of a circular plate, which can be made to extend into the power supply device for intermeshing engagement with a drive gear in the power supply unit. For this reason, assembling work for the water pump unit is simpler and easier than in the case of a chain drive device for the water pump unit.

The attachment surface with which the water pump case is attached to the power supply device is formed to extend along the driven gear. According to the third form of the invention, the driven gear has a radial size greater than an axial size thereof in the direction of the drive shaft. Therefore, the attachment surface is an elongated surface extending along a plane perpendicular to the drive shaft. As a result, the water pump unit can be made to have a reduced size in the direction of the drive shaft, whereby, even when stresses are produced in the water pump unit during its operation, strains produced thereby in the water pump unit is small because of the small size of the attachment surface in the direction of the drive shaft.

According to the fourth form of the invention, the attachment surface with which the water pump case is attached to the crankcase of the internal combustion engine is formed to extend along the driven gear, so that the attachment surface can be made to have a small size, and an opening to be formed in the attachment surface of the crankcase can be made small to fit the contour of the driven gear with resultant increase in the rigidity of the crankcase.

According to the fifth form of the invention, the fixing bolts make it easy to precisely adjust the intermeshing engagement between the drive gear of the power unit and the driven gear of the water pump unit.

BEST MODE FOR CARRYING OUT THE INVENTION

Figure 1:
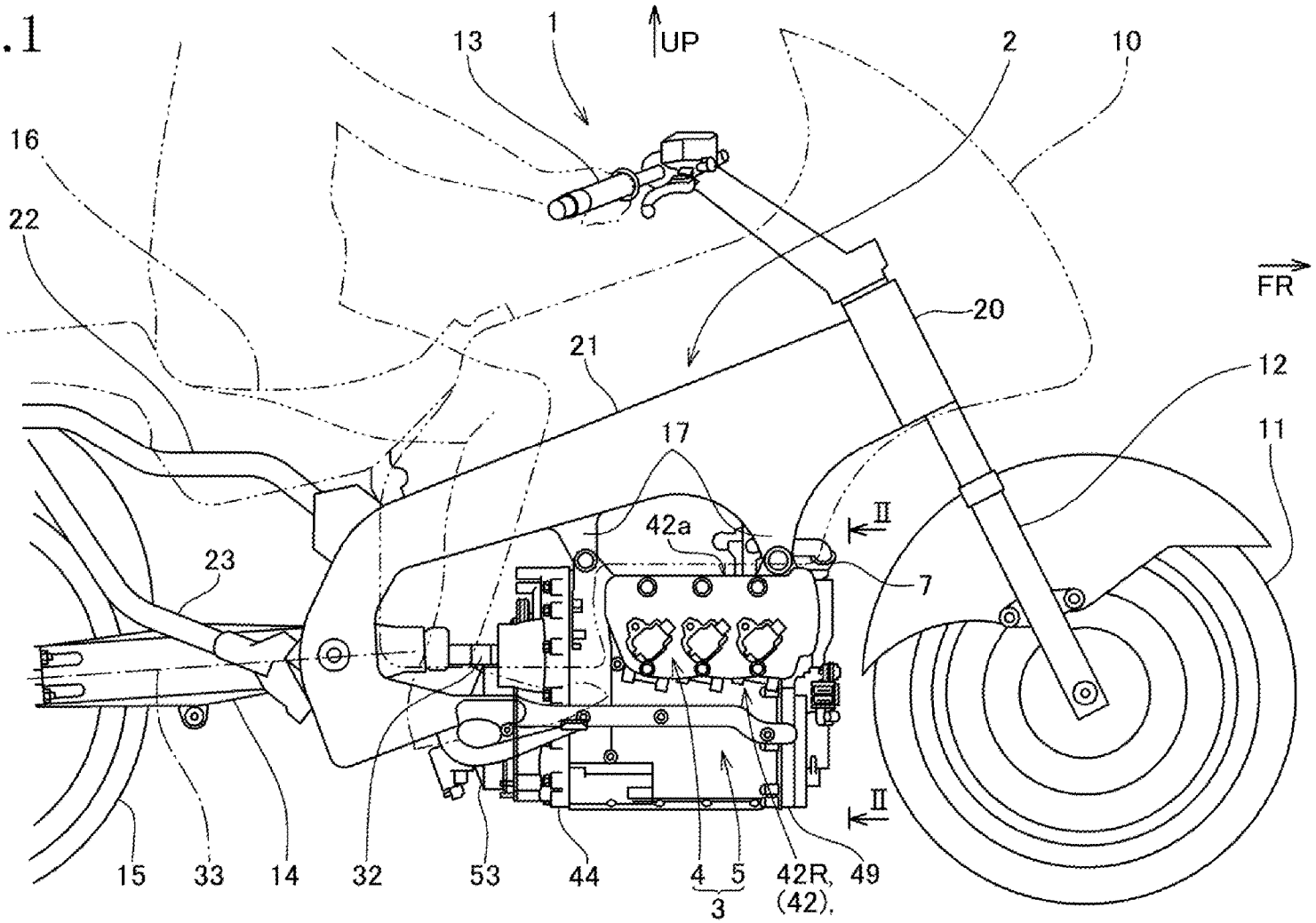
FIG. 1 is a right side view showing a principal part of a motorcycle with a power unit in which is mounted a water pump unit according to an embodiment of the present invention.

An embodiment of a water pump unit according to the present invention will be described with FIGS. 1-8 of the drawings.

In the claims and description, directions such as "front", "rear", "left", "right", "upward" and "downward" mean the directions with respect to a vehicle on which a power unit with the water pump unit according to an embodiment of the invention is mounted. In the embodiment disclosed hereinbelow, the vehicle is a saddle-type vehicle, more particularly, a motorcycle.

In the drawings, "FR" means the front side of the vehicle, "LH" the left side, "RH" the right side and "UP" the upper side.

FIG. 1 is a right side view showing a principal part of a motorcycle 1 having a power unit 3 mounted thereon and attached with a water pump unit 7 according to an embodiment of the invention.

In FIG. 1, the motorcycle 1 has a body cover 10 partially shown in simplified way in the two-dot chain line. The figure does not show the suction system, the exhaust system, fuel supply system, etc. and shows only the principal part of the motorcycle.

The motorcycle has a body frame 2, which includes a head pipe 20 supporting therein a front fork 12 for steering, rotatably supporting a front wheel 11, a main frame 21 extending rearward and downward from the head pipe 20, sheet rails 22 extending rearward and upward from the rear end of the main frame 21, and back stays 23 connecting the rear end of the main frame with portions near the rear ends of the sheet rails 22.

A steering handle bar 13 is connected to the upper end of the front fork 12. To the rear end of the main frame 21 are joined front ends of swing arms 14 in a manner that the swing arms 14 are swingable up and down. A rear wheel 15 is rotatably supported on the rear ends of the swing arms 14.

Between a portion above the rear end of the main frame 21 and the swing arms 14 are provided rear cushion units not shown, and a rider's sheet 16 is attached on the sheet rails 22.

A power unit 3 for driving the rear wheel 15 is disposed in the space below the main frame 21. The power unit 3 is supported by the main frame 21 through a plurality of hanger members 17.

The power unit 3 has an output shaft 32 connected to the rear wheel 15 through a drive shaft 33 extending along the swing arm 14, to transmit the rotational motive power to the rear wheel 15.

Figure 2:
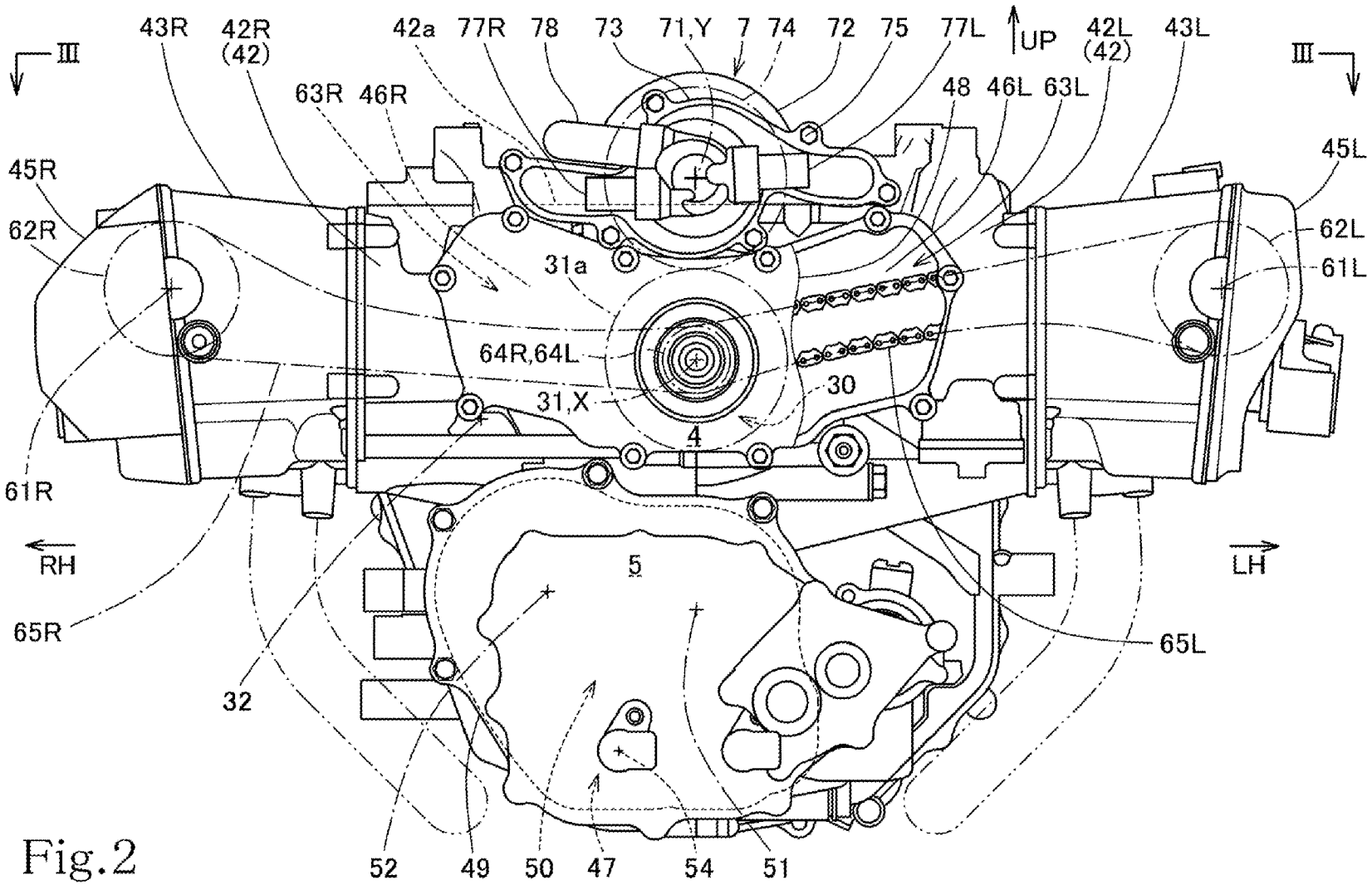
FIG. 2 is a front view of the power unit as viewed in the arrow direction of II-II in FIG. 1, a front portion of the water pump unit being seen in a state mounted to the power unit.

FIG. 2 is a front view of the power unit 3 as viewed in the arrow direction of II-II in FIG. 1.

As shown in FIGS. 1 and 2, the power unit 3 is made up of a 4-stroke cycle, water-cooled, 6-cylinder internal combustion engine 4 of horizontally-opposed type, and a transmission 5 for speed change of the rotational power of the engine 4 and for reversal of the rotational direction.

The internal combustion engine 4 is made up of a crankcase 42 consisting of a left-side and right-side crankcase sections 42L and 42R with respect to the running direction of the motorcycle 1, left-side and right-side cylinder heads 43L and 43R joined to the left and right outer ends of the crankcase sections 42L and 42R, respectively, and a rear cover 44 (FIG. 1) joined to the crankcase sections 42L and 42R.

The rear cover 44 is joined to close the rear ends of the crankcase sections 42L and 42R.

To the left and right outer ends of the left-side and right-side cylinder heads 43L and 43R are joined left-side and right-side cylinder head covers 45L and 45R, respectively. These left-side and right-side cylinder head covers 45L and 45R function to cover left-side and right-side valve operating mechanisms and their driven sprockets 62L and 62R on cam shafts 61L and 61R, which are all provided within the left-side and right-side cylinder heads 43L and 43R, respectively.

The left-side and right-side crankcase sections 42L and 42R are mutually abutted and joined together and cooperate to rotatably support on their abutting surfaces a crankshaft 31 extending in the longitudinal direction of the motorcycle 1, and to define a crank chamber 30 about the crankshaft.

The left-side and right-side crankcase sections 42L and 42R contain therein left-side and right-side cylinder blocks 46L and 46R positioned at the left-side and right-side of the crank chamber 30, respectively. Within each of the left-side and right-side cylinder blocks 46L and 46R are formed three parallel cylinder bores slidably receiving therein pistons, not shown, connected to the crankshaft 31 via connecting rods not shown, respectively.

Under the crank chamber 30 defined by the left-side and right-side crankcase sections 42L and 42R is formed a transmission chamber 50, in which are supported a main shaft 51 and a counter shaft 52 of the transmission 5, extending in parallel with the crankshaft 31 and in the longitudinal direction of the motorcycle. Below the transmission chamber 50 in the left-side and right-side crankcase sections 42L and 42R is formed an oil pan 47.

To the rear surface of the rear cover 44 is attached a clutch cover 53 covering a clutch mechanism, not shown, provided coaxially with the main shaft 51 of the transmission 5. The output shaft 32 of the power unit 3 extends to the rear through the rear cover 44 (see FIG. 1).

The output shaft 32 extends to the rear along the swing arm 14 and is connected to the drive shaft 33 (see FIG. 1) to transmit the rotational power of the engine 4 to the rear wheel 15.

Reference is made to FIG. 2, which is a front view of the power unit 3 as viewed in the arrow direction of II-II in FIG. 1

As shown in FIG. 2, a cam chain chamber cover 48 is provided, which is joined to the left-side and right-side crankcase sections 42L and 42R in a region around the crankshaft 31 to cover and close the front side of the crank chamber 30. A transmission holder 49 is further provided, which is joined to the left-side and right-side crankcase sections 42L and 42R to close the front side of the transmission chamber 50, in a region around the main and counter shafts 51 and 52 of the transmission 5 located below the crankshaft 31 and around a shift drum 54 (only its center axis is shown in FIG. 2), etc.

The transmission chamber 50 is formed to enclose the transmission 5 in the region from the transmission holder 49 to the interior spaces of the left-side and right-side crankcase sections 42L and 42R.

Within the left-side and right-side crankcase sections 42L and 42R are formed left-side and right-side cam chain chambers 63L and 63R along the front sides (the side viewed in FIG. 2) of the left-side and right-side cylinder blocks 46L and 46R, respectively. The cam chain chambers 63L and 63R are in communication with the interior spaces of the left-side and right-side cylinder heads 43L and 43R, respectively. The cam chain chamber cover 48 forms a part of the wall covering the cam chain chambers 63L and 63R.

In FIG. 2, the cam chain chamber cover 48 is shown in a partly removed state in its left side (right side in the figure), the left-side cylinder blocks 46L is seen behind the removed portion of the cover 48, and the left-side cam chain chamber 63L is seen in front of the cylinder blocks 46L. A left-side cam chain 65L is further shown.

There is the same arrangement on the right side (left side in the figure) of the cam chain chamber cover 48. The right-side cylinder blocks 46R, the right-side cam chain chamber 63R and a right-side cam chain 65R are seen.

The left-side cam chain 65L extends in the left-side cam chain chambers 63L and is passed between a driving sprocket 64L on the front end of the crankshaft 31 and the driven sprocket 62L on the cam shaft 61L of the left-side valve operating mechanism.

The right-side cam chain 65R extends in the right-side cam chain chambers 63R and is passed between a driving sprocket 64R on the front end of the crankshaft 31 and the driven sprocket 62R on the cam shaft 61R of the right-side valve operating mechanism.

The left and right valve operating mechanisms are constructed as described above, and the suction valves and the exhaust valves for respective cylinder bores, not shown, are opened and closed at predetermined timings in synchronism with the rotation of the crankshaft 31.

A drive gear 31*a* for driving a water pump unit described later is fixedly fitted on the front end of the crankshaft 31.

The internal combustion engine 4 of the power unit 3 incorporating an embodiment of the invention is a 4-stroke cycle, water-cooled, 6-cylinder internal combustion engine of horizontally-opposed type, and is provided with a water pump unit 7 for supplying cooling water.

The water pump unit 7 is, as shown in FIG. 1, is fixedly mounted on a front part of an upper wall 42*a* of the crankcase made up of the mutually joined crankcase sections 42L and 42R of the power unit 3 as a power supply device.

Figure 3:
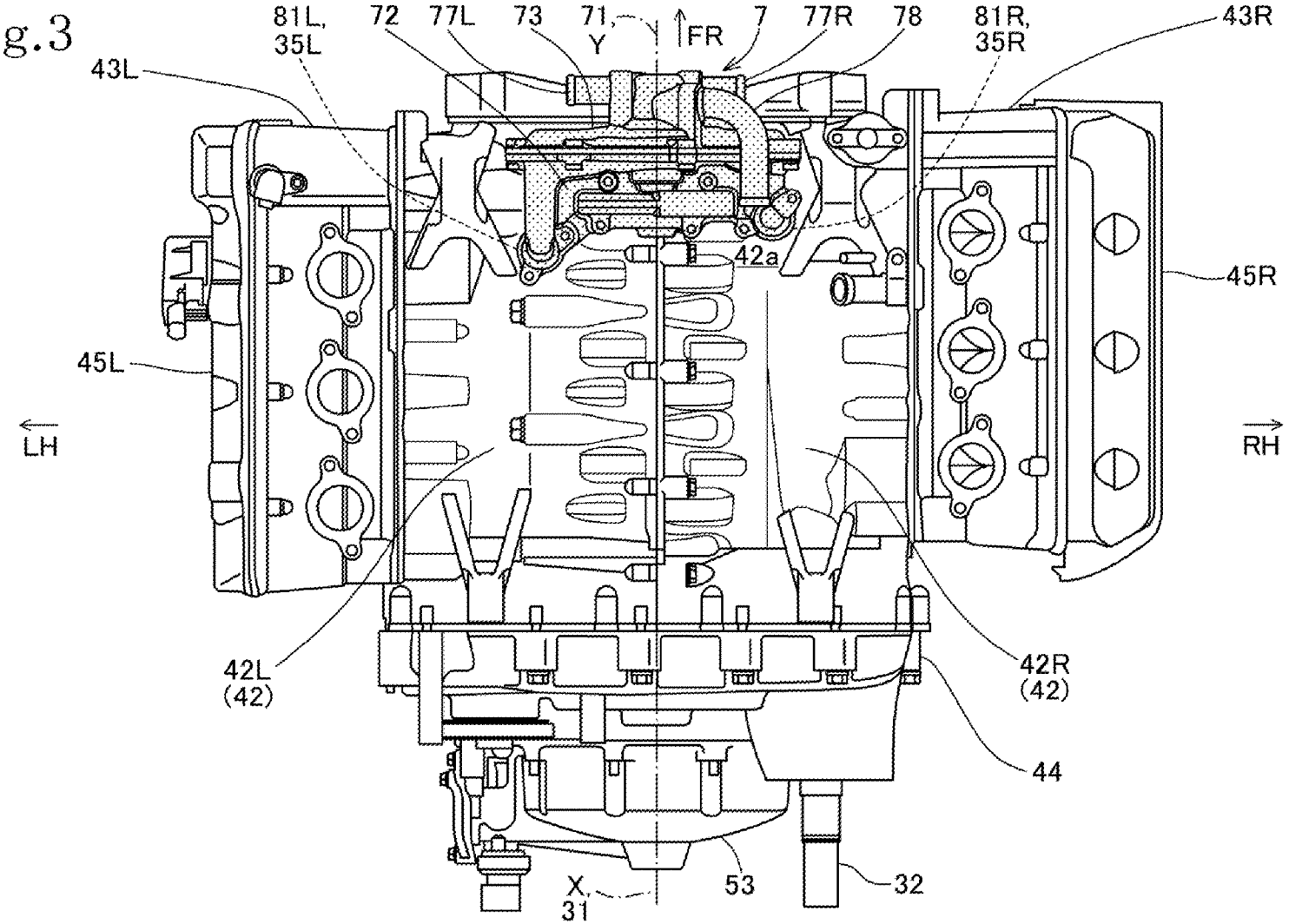
FIG. 3 is a plan view of the power unit as viewed in the arrow direction of in FIG. 2, the upward direction in FIG. 3 being a front direction of the power unit and the water pump unit of the invention being mounted on a front upper part of the power unit.

FIG. 2 shows an upper front part of the mutually joined left-side and right-side crankcase sections 42L and 42R of the power unit 3 and the front view of the water pump unit 7 fixedly mounted on the front part of the upper wall 42*a* of the crankcase. FIG. 3, a plan view as viewed in the direction of the III-III line, shows the water pump unit 7*a* and the crankcase upper wall 42*a* as seen from above.

As will be noted from these figures, the water pump unit 7 includes a water pump case 72 fixedly mounted on the crankcase upper wall 42*a*, and a water pump housing 73. The water pump case 72, as fixedly mounted on the crankcase upper wall 42*a*, supports therein a drive shaft 71 for driving an impeller, not shown, of the pump unit, and the drive shaft 71 extends with its rotational axis Y positioned above and in parallel with the rotational axis X of the crankshaft 31. The water pump housing 73 is connected to the front part of the water pump case 72 and defines a pump chamber 70 having the impeller therein.

Figure 7:
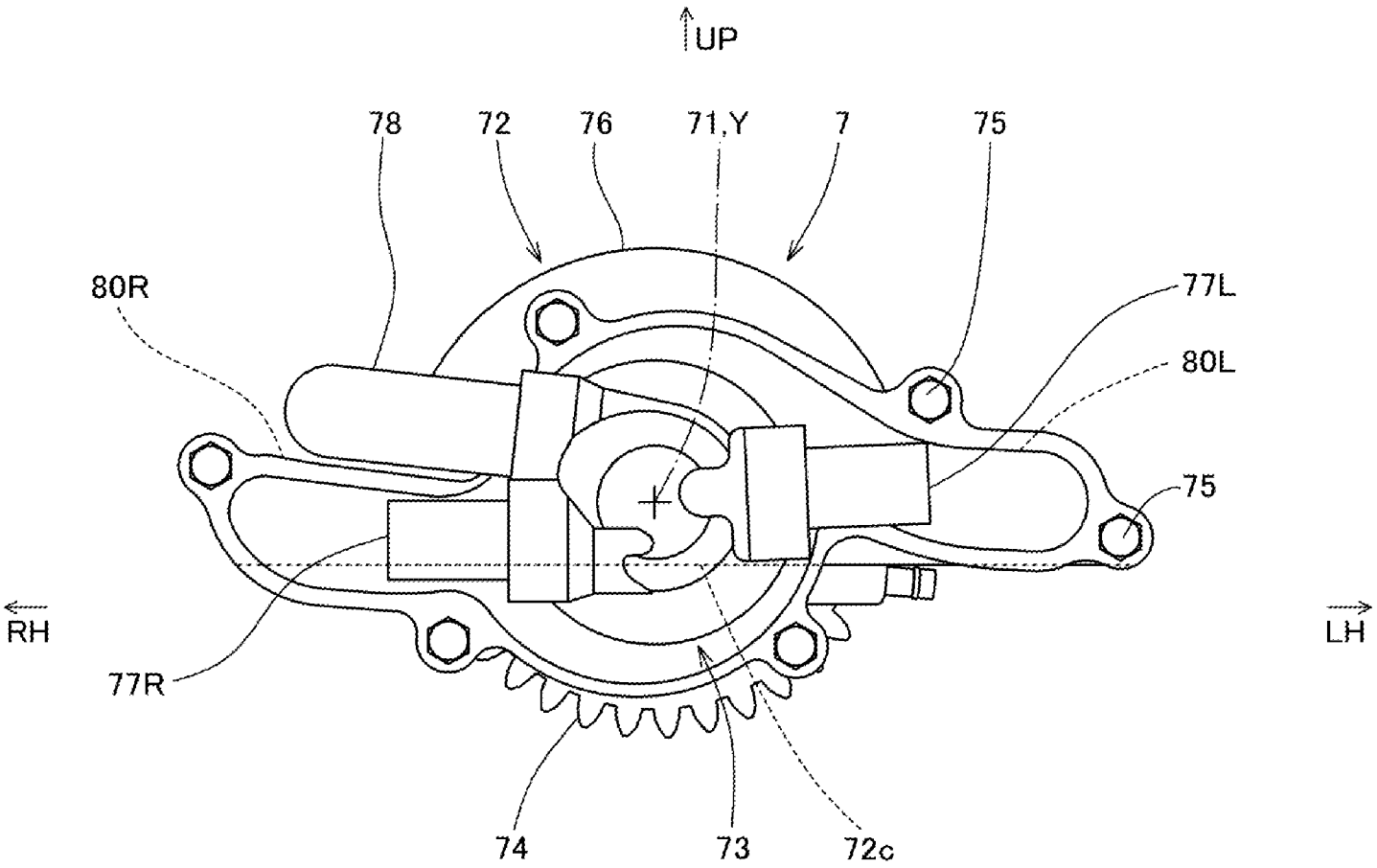
FIG. 7 is a front view of the water pump unit as viewed in the arrow direction of VII-VII in FIG. 4.
Figure 8:
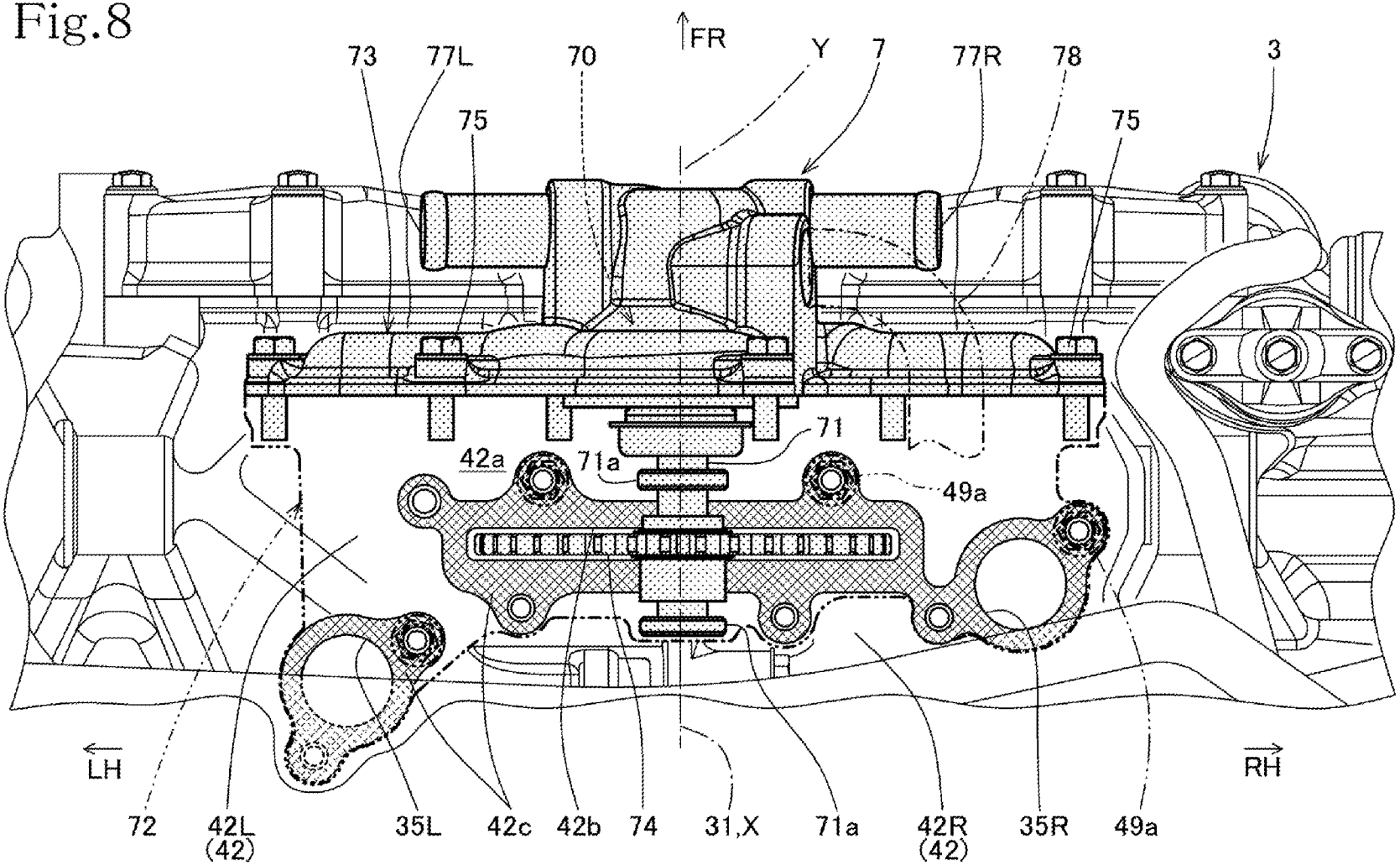
FIG. 8 is an enlarged plan view showing a principal front portion of the power unit with the water pump unit mounted thereon as shown in FIG. 3 and further showing a water pump cover joined to a water pump housing, a drive shaft and a driven gear supported by the water pump housing, the water pump housing being shown in outer contour by two-dot chain line.

Referring also to FIGS. 7 and 8, the drive shaft 71 is rotatably supported by bearings 71*a* in the water pump case 72, and driven gear 74, as a power transmission member for transmitting motive power of the power unit 3 to the drive shaft 71, is supported on the drive shaft 71.

A part of the driven gear 74 protrudes downward from within the water pump case 72 (see FIG. 5) and extends through a crankcase opening 42*b* (see FIG. 8) formed in the upper wall 42*a* into the crankcase 42 to mesh with the water pump drive gear 31*a* on the crankshaft 31.

The water pump case 72 has a bottom wall forming an attachment surface 72*c* (see FIG. 6) for attachment to the crankcase 42 of the power unit 3, as a power supply device. The crankcase upper wall 42*a* of the power unit 3 is formed with an attachment surface 42*c* (see FIG. 8). The bottom wall forming the attachment surface 72*c* is formed with a water-pump-side opening 72*b* (see FIG. 6) for allowing the driven gear 74 to extend therethrough. The crankcase upper wall 42*a* forming the attachment surface 42*c* has a crankcase-side opening 42*b* (see FIG. 8) for allowing the driven gear 74 to extend therethrough. Thus, the driven gear 74 extends through both these openings.

The attachment surface 42*c* is a surface in parallel with the rotational axis X of the crankshaft 31 and extends horizontally in the left-to-right direction.

On the other hand, the rotational axis Y of the drive shaft 71 is disposed directly above, and in parallel with the rotational axis X of the crankshaft 31, in the state of the water pump unit 7 being attached or joined to the crankcase upper surface 42*a*. Therefore, the attachment surface 42*c* forms a plane parallel to the rotational axis Y of the drive shaft 71 of the water pump unit 7.

Figure 4:
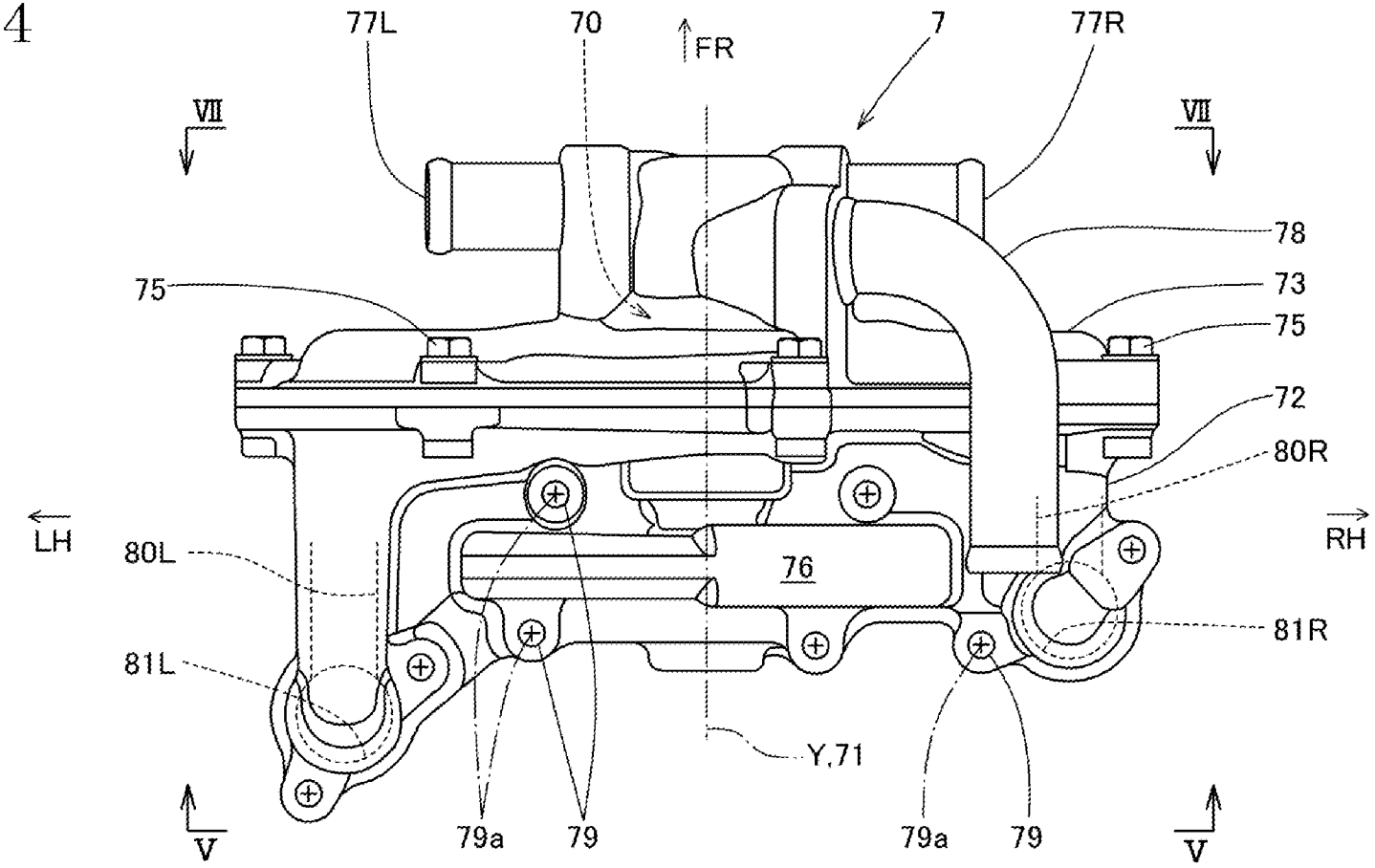
FIG. 4 is a plan view of the water pump unit according to the embodiment of the invention, the upward direction in the figure being a front direction of the water pump unit mounted on the power unit.

As shown in FIG. 4, the water pump unit 7 has its water pump case 72 located in the area adjoining the rear end portion of the drive shaft 71 and has its water pump housing 73 fixedly attached to the front part of the water pump case 72 by means of fixing bolts 75.

The front end of the drive shaft 71 enclosed in and supported by the water pump case 72 extends into the pump chamber 70 in the water pump housing 73 and has the impeller, not shown, attached to the front end thereof.

The upper portion of the driven gear 74 fixedly supported on the drive shaft 71 is covered by an upwardly bulging arcuate portion 76 of the water pump case 72.

In the water pump case 72 is provided a left discharge passage 80L, communicating with the pump chamber 70 in the water pump housing 73, at the left side of the upwardly bulging arcuate portion 76. The left discharge passage 80L extends rearward and terminates at a downwardly open left discharge port 81L. A right discharge passage 80R, communicating with the pump chamber 70 in the water pump housing 73, is provided at the right side of the upwardly bulging arcuate portion 76. The right discharge passage 80R extends rearward and terminates at a downwardly open right discharge port 81R.

In the state in which the water pump case 72 is mounted on the crankcase 42, the left discharge port 81L is connected to a left cooling water inlet 35L (see FIG. 8), which is in communication with a water jacket in the left-side cylinder block 46L (see FIG. 2) of the left-side crankcase section 42L. The right discharge port 81R is connected to a right cooling water inlet 35R (see FIG. 8), which is in communication with a water jacket in the right-side cylinder block 46R (see FIG. 2) of the right-side crankcase section 42R.

As shown in FIG. 7, which is a front view of the water pump unit 7, the water pump housing 73 is provided with a left return port 77L which leads to the pump chamber 70 and receives cooling water from a left radiator (not shown). The water pump housing 73 is provided further with a right return port 77R, at a lowered level, which leads to the pump chamber 70 and receives cooling water from a right radiator (not shown). The water pump housing 73 is further provided with a bypass return port 78 at a raised level so as to be directed to the right and to receive cooling water from a thermostat.

Figure 6:
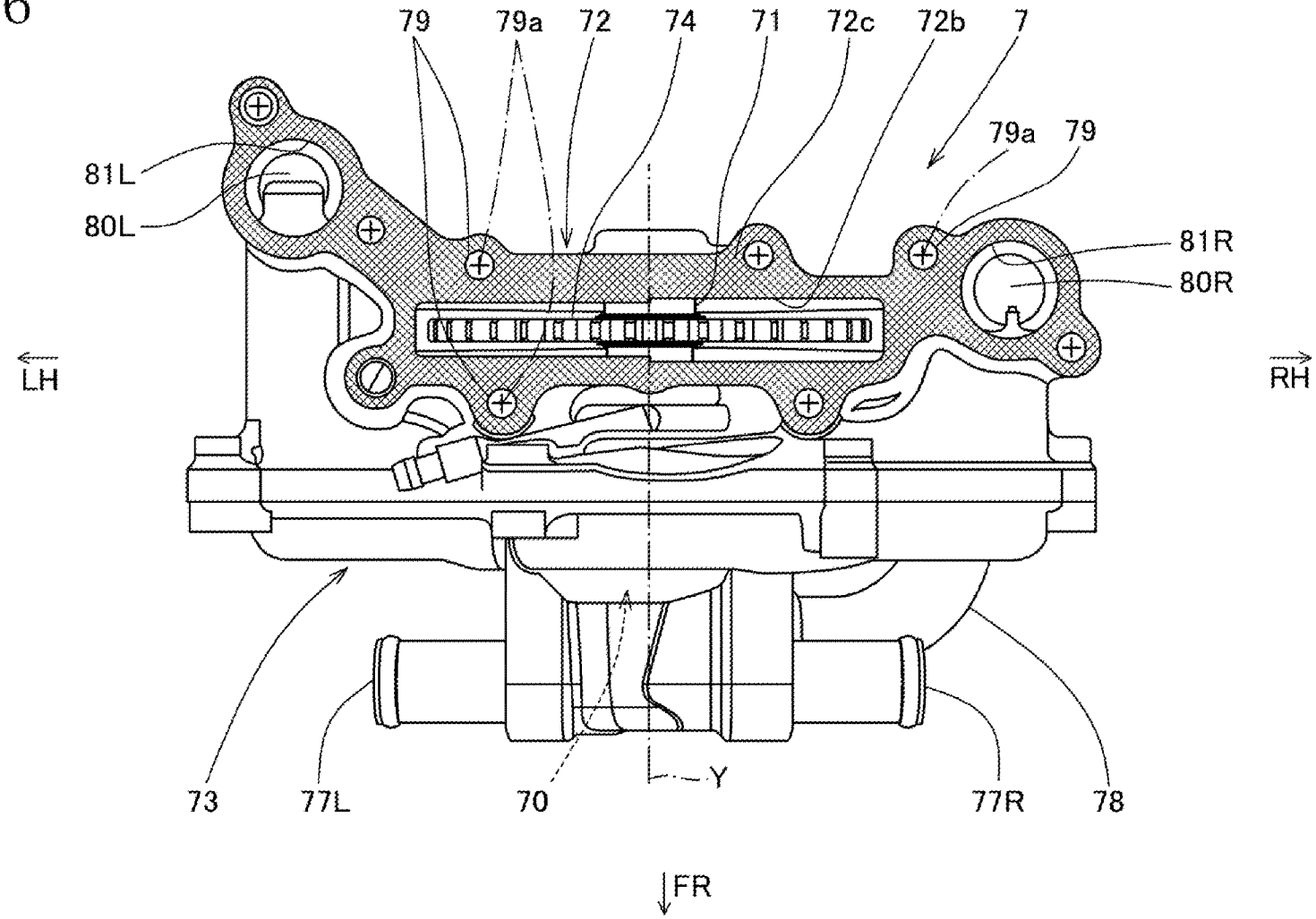
FIG. 6 is a bottom view of the water pump unit as viewed in the arrow direction of VI-VI in FIG. 5.

As shown in FIG. 6, which is a bottom view of the water pump unit 7, the water pump unit 7 has, on a rear part of the bottom of the water pump case 72, the attachment surface 72*c* for attachment onto the crankcase upper wall 42*a*. The attachment surface 72*c* is formed with the water-pump-side opening 72*b* and the left and right discharge ports 81L and 81R.

The water-pump-side opening 72*b* formed in the attachment surface 72*c* is shaped along the outer contour of the driven gear 74, to allow the driven gear 74 to extend therethrough. The attachment surface 72*c* is accordingly shaped in relatively small size along the outer contour of the driven gear 74. Consequently, the crankcase opening 42*b* of the crankcase 42, provided to pass the driven gear 74 therethrough, can also be made small so that the crankcase 42 can be made to have high rigidity.

The driven gear 74 passed through the water-pump-side opening 72*b* is in the form of a circular plate and has a radial size greater than its thickness size in the direction of the rotational axis Y of the drive shaft 71. Therefore, the attachment surface 72*c* is a surface extending along a plane perpendicular to the axis Y of the drive shaft 71. Thus, the attachment surface 72*c* can be made to have a small size in the direction of the axis Y of the drive shaft 71. Therefore, even when the water pump unit 7 is subjected to a stress during its operation, strain that occurs as a result of such stress can be made small since the attachment surface 72*c* has a small breadth in the direction of the axis Y of the drive shaft 71.

FIG. 8 is an enlarged plan view showing a principal front portion of the power unit 3 to which the water pump unit 7 is mounted, and shows the attachment surface 42*c* on the upper surface 42*a* of the power unit 3, and the crankcase-side opening 42*b*.

The contour of the water pump case 72 of the water pump unit 7 is shown in the two-dot chain line. The figure also shows the water pump housing 73 connected to the water pump case 72, the drive shaft 71 supported by the water pump case, the driven gear 74, and the bearings 71*a* for the drive shaft 71.

FIG. 8 also shows the members forming the water pump unit 7 in dotted pattern for facilitating identification of these members.

As FIG. 8 shows, the attachment surface 42*c* of the crankcase 42, to which the water pump case 72 is attached, is formed also along the outer contour of the driven gear 74 within the water pump case 72. This enables the attachment surface 42*c* to be formed in small size, so that the crankcase-side opening 42*b* formed in the attachment surface 42*c* of the crankcase 42 can also be made to have a small size adaptable for the driven gear 74, with the result that the rigidity of the crankcase 42 is secured.

Figure 5:
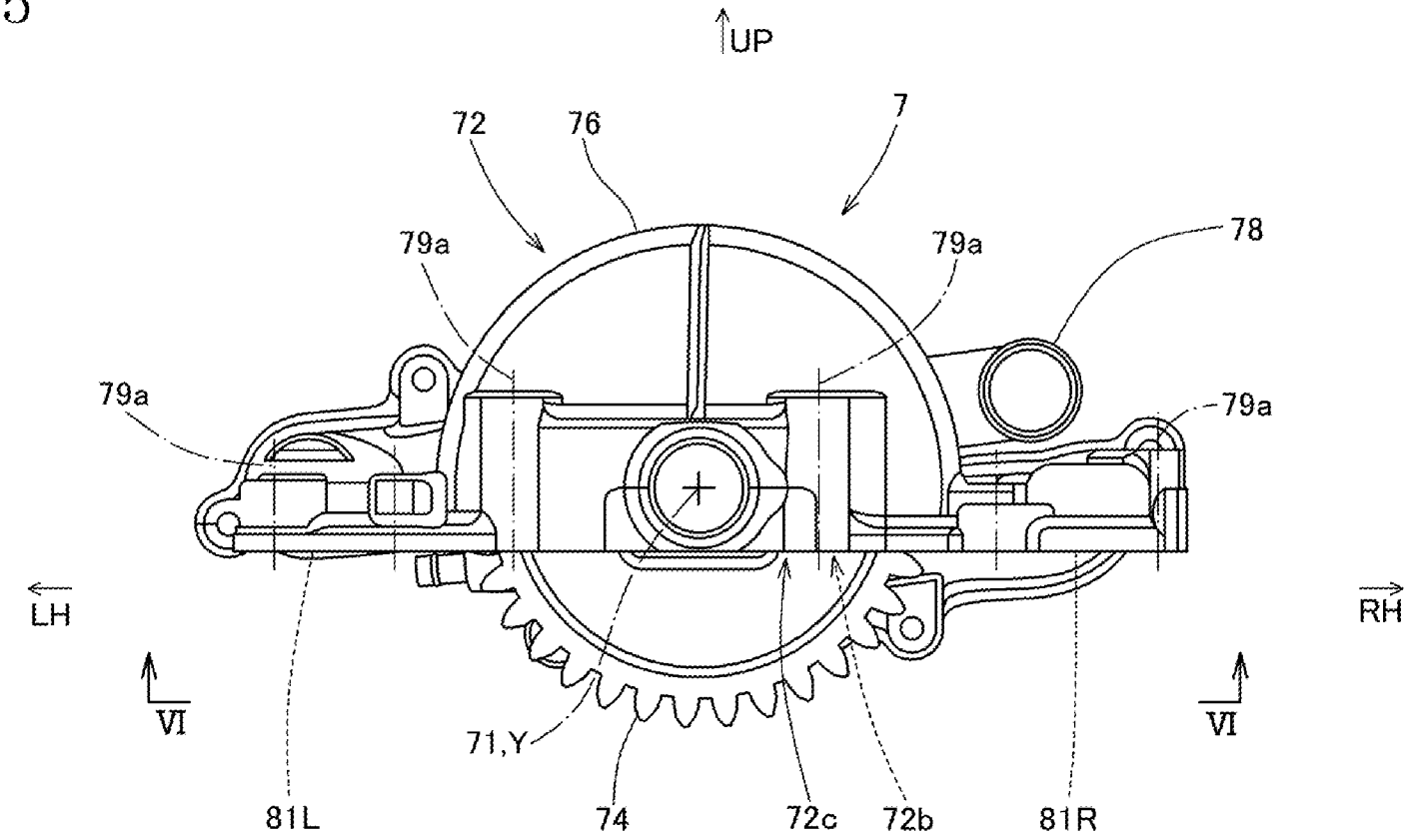
FIG. 5 is a rear view of the water pump unit as viewed in the arrow direction of V-V in FIG. 4.

As shown in FIG. 5, which is a view of the rear side of the power unit as a power supply device, the circular disc-shaped driven gear 74 as a driven member partly protrudes downward from the water pump case 72 to a position below the attachment surface 72*c*.

Therefore, as indicated in FIG. 8, when the water pump case 12 is to be mounted on the power unit 3, it is only required to insert the protruding part of the driven gear 74 into the crankcase opening 42*b* in the upper wall 42*a* of the power unit 3. By doing so, the driven gear 74 is brought into meshing engagement with the water pump drive gear 31*a* on the crankshaft 31 on the side of the power unit 3. Thus, the assembling operation of the water pump unit 7 is simple and is made easy in comparison with the case of a chain drive system.

As shown in FIG. 4, the water pump case 72 is formed with two fixing holes 79 in each of the front and rear of the upwardly bulging portion 76, that is, two fixing holes around the left discharge port 81L, and two fixing holes 79 around the right discharge port 81R. These fixing holes are used to fix the water pump case 72 to the crankcase upper wall 42*a*. The direction of extension of these fixing holes 79, that is, the direction of fixing bolts 79*a* (see FIG. 8 in which heads of the bolts are shown in two-dot chain line) is perpendicular to the attachment surface 72*c* and to the direction of the axis Y of the drive shaft 71.

For this reason, by adjusting the tightening degree of the fixing bolts 79*a*, meshing engagement between the driven gear 74 on the side of the water pump unit 7 and the drive gear 31*a* on the side of the of the power unit 3 can be adjusted easily with a high degree of precision.

The technical features of the water pump unit 7 according to the embodiment of the invention and its advantages and effects will be summarized below.

The water pump unit 7 includes the water pump case 72 having therein the drive shaft 71 for driving the impeller, and the driven gear 74 as the power transmission member for transmitting the motive power of the power unit 3, as a power supply device, to the drive shaft 71. The water pump case 72 encases and supports the drive shaft 71, and the driven gear 74 is supported by the water pump case 72 via the drive shaft 71 and protrudes in part from within the water pump case 72. The attachment surface 72*c* for attachment of the water pump case 72 to the power unit 3 is formed with the water-pump-side opening 72*b* formed along the driven gear 74. Therefore, the area of the attachment surface 72*c* extends along the outer contour of the driven gear 74.

By so forming the attachment surface 72*c* of the water pump case 72 as to extend along the outer contour of the driven gear 74, the attachment surface 72*c* is made to have a small area, whereby the crankcase opening 42*b* on the side of the power unit 3 can also be made small and the rigidity of the power unit 3 as the power supply device is secured.

The power transmission member is in the form of the circular-plate driven gear 74 driven by the power unit 3 as the power supply device. This enables the power transmission member in the form of the driven gear 74 to be merely slide into the power unit 3 to cause the power transmission member to be connected to or meshed with the water pump drive gear 31*a* on the side of the power unit 3. This means that the assembling operation of the water pump unit 7 is more simple and easy than that of the chain-drive device.

The driven gear 74 is supported on the drive shaft 71, and the radial size of the driven gear 74 is greater than the axial size of the driven gear 74 along the drive shaft 71. This naturally results in that the attachment surface 72*c*, for use in mounting the water pump unit 7 on the power unit 3, is formed along the plane of the driven gear 74, so as to occupy an elongated area extending along a line normal to the rotational axis Y of the drive shaft 71. Therefore, the area occupied by the attachment surface 72*c* is small in the direction of the rotational axis Y of the drive shaft 71. As a consequence, even when stresses are produced in the water pump unit 7 as a result of operation of the water pump unit 7, strains produced thereby can be suppressed to a small degree because of the small area occupied by the attachment surface 72*c* in the direction of the rotational axis y of the drive shaft 71.

The power supply device is the power unit 3 including the internal combustion engine 4, the water pump unit 7 is mounted on the crankcase 42 of the power unit 3, and the attachment surface 42*c* on the crankcase 42, for supporting the water pump case 72, is shaped to extend along the outer contour of the driven gear 74. This enables the attachment surface 42*c* to have a small occupying area. Furthermore, the crankcase opening 42*b* formed in the attachment surface 42*c* of the crankcase 42 can be made small in size into conformity with the driven gear 74, so that rigidity of the crankcase 42 can be retained reliably.

The water pump unit 7 is fixedly mounted on the crankcase 42 of the power unit 3 with the use of the fixing bolts 79*a*. These fixing bolts 79*a* extend in directions perpendicular to the axis of the drive shaft 71 of the pump unit 7. As a result, the intermeshing engagement between the driven gear 74 on the side of the water pump unit 7 and the drive gear 31*a* on the side of the power unit 3 can be adjusted easily and precisely.

One embodiment of the invention has been described above. The present invention is not limited to the embodiment disclosed but can be practiced in various ways within the scope of the invention.

For example, the power supply device is not limited to the disclosed power unit provided with an internal combustion engine, and the transmission member is not limited to the driven gear.

The internal combustion engine of the power unit is not limited to the 6-cylinder, horizontally-opposed type engine disclosed.

Arrangement of various elements of the power unit and the water pump unit has been described in the above embodiment with respect to their left-right arrangement relative to the motorcycle shown, but the invention also includes a case of reverse arrangement relative to the motorcycle.

REFERENCE LETTERS

3 . . . Power unit (Power supply device), 4 . . . Internal combustion engine, 7 . . . Water pump unit, 31 . . . Crankshaft, 31*a* . . . Water pump drive gear, 42 . . . Crankcase, 42*a* . . . Crankcase upper surface, 42*b* . . . Crankcase opening (Opening), 42*c* . . . Attachment surface, 42L . . . Left-side crankcase section, 42R . . . Right-side crankcase section, 70 . . . Pump chamber, 71 . . . Drive shaft, 71*a* . . . Bearing, 72 . . . Water pump case, 72*b* . . . Water-pump-side opening, 72*c* . . . Water-pump-side attachment surface (Attachment surface), 73 . . . Water pump housing, 74 . . . Driven gear (Power transmission member), 77L . . . Left return port, 77R . . . Right return port, 78 . . . Bypass return port, 79 . . . Fixing hole, 79*a* . . . Fixing bolt, 80L . . . Left discharge passage, 80R . . . Right discharge passage, 81L . . . Left discharge port, 81R . . . Right discharge port, X . . . Axis of the crankshaft 31, Y . . . Axis of the drive shaft 71 of the water pump unit 7.

The invention claimed is:

1. A water pump unit including a water pump case provided with a drive shaft for driving an impeller, and a power transmission member for transmitting power from a power supply device to the drive shaft; wherein:

the power transmission member is a driven gear driven by the power supply device;

the drive shaft having the impeller connected at one end and the drive gear connected at the other end;

the water pump case supports the drive shaft therein and is attached to an engine crankcase of the power supply device;

the driven gear is supported by the drive shaft and by the water pump case through the drive shaft;

the crankcase has a planar upper surface formed with a crankcase-side opening;

the water pump case has a planar attachment surface formed with a water-pump-side opening located downward of the drive shaft, the planner attachment surface being formed to face the planar upper surface of the crankcase and to make the driven gear protrude downward from within the water pump case;

the planar attachment surface of the water pump case is attached to the planar upper surface of the crankcase with the water-pump-side opening of the water pump case coinciding with the crankcase-side opening;

the driven gear extends in part through the water-pump-side opening of the water pump case and through the crankcase-side opening of the crankcase, so as to protrude into the crankcase along the two openings into intermeshing engagement with the power supply device; and the driven gear has a radial size greater than an axial size thereof in the direction of the drive shaft.

2. The water pump unit as defined in claim 1, wherein the water pump unit is attached to the crankcase of the power unit by means of fixing bolts, and the fixing bolts extend in a direction perpendicular to the drive shaft of the water pump unit.

3. The water pump unit as defined in claim 1, wherein the drive shaft is supported by a plurality of bearings supported by the water pump case, and the driven gear is supported between the bearings.

4. The water pump unit as defined in claim 1, wherein the driven gear is in the shape of a circular plate, and the water-pump-side opening and the crankcase-side opening have a shape configured along the circular plate.

5. The water pump unit as defined in claim 2, wherein the drive shaft is supported by a plurality of bearings supported by the water pump case, and the driven gear is supported between the bearings.

6. The water pump unit as defined in claim 2, wherein the driven gear is in the shape of a circular plate, and the water-pump-side opening and the crankcase-side opening have a shape configured along the circular plate.

7. The water pump unit as defined in claim 3, wherein the driven gear is in the shape of a circular plate, and the water-pump-side opening and the crankcase-side opening have a shape configured along the circular plate.

* * * * *